US008123471B2

(12) United States Patent
Mielke et al.

(10) Patent No.: US 8,123,471 B2
(45) Date of Patent: Feb. 28, 2012

(54) VARIABLE STATOR VANE CONTOURED BUTTON

(75) Inventors: Mark Joseph Mielke, Blanchester, OH (US); Andrew Breeze-Stringfellow, Cincinnati, OH (US); David Scott Clark, Liberty Township, OH (US); James Edwin Rhoda, Mason, OH (US); Gary Robert Peters, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 459 days.

(21) Appl. No.: 12/401,960

(22) Filed: Mar. 11, 2009

(65) Prior Publication Data

US 2010/0232936 A1 Sep. 16, 2010

(51) Int. Cl.
*F01D 17/12* (2006.01)

(52) U.S. Cl. ..... 415/160; 415/209.3

(58) Field of Classification Search ..... 415/159–161
See application file for complete search history.

(56) References Cited

U.S. PATENT DOCUMENTS

| | | | | |
|---|---|---|---|---|
| 4,231,703 | A | 11/1980 | Weiler | |
| 4,950,129 | A | 8/1990 | Patel et al. | |
| 6,283,705 | B1 * | 9/2001 | Rice et al. | 415/160 |
| 6,435,821 | B1 | 8/2002 | Nicolson et al. | |
| 6,461,105 | B1 | 10/2002 | Nicolson | |
| 6,843,638 | B2 | 1/2005 | Hidalgo et al. | |
| 7,413,401 | B2 | 8/2008 | Szucs et al. | |
| 2008/0131268 | A1 * | 6/2008 | Guemmer | 415/160 |
| 2010/0098529 | A1 * | 4/2010 | Roby et al. | 415/160 |

FOREIGN PATENT DOCUMENTS

EP 1262635 A1 4/2002

OTHER PUBLICATIONS

Mark Mielke, RTA / GE57 Subscale Fan Rig Final Report—Mechanical Design, GE Aviation, Oct. 31, 2007, Document No. R2007AE777, vol. 1, Section 3, 19 pages.

* cited by examiner

*Primary Examiner* — Steven Loke
*Assistant Examiner* — Victoria Hall
(74) *Attorney, Agent, or Firm* — William Scott Andes; Steven J. Rosen

(57) ABSTRACT

A variable stator vane airfoil is mounted on a button centered about a rotational axis and includes circular leading and trailing edges circumscribed about the rotational axis at a button radius. Contoured pressure and suction sides extend from the circular leading edge to the circular trailing edge and are recessed inwardly from a perimeter circumscribed about the rotational axis at the button radius. One of upstream and downstream pressure side portions of the contoured pressure side is straight and another of the upstream and downstream pressure side portions is convexly curved. One of the upstream and downstream suction side portions is straight and another of the upstream and downstream suction side portions is convexly curved. One of the upstream pressure side portion and upstream suction side portion is straight and another of the upstream pressure side portion and upstream suction side portion is convexly curved.

11 Claims, 8 Drawing Sheets

VARIABLE STATOR VANE CONTOURED BUTTON

BACKGROUND OF THE INVENTION

1. Technical Field

This invention relates to aircraft gas turbine engines and, particularly, to variable stator vane buttons.

2. Background Information

Variable stator vanes are commonly used in aircraft gas turbine engine compressors and fans and in some turbine designs. Non-rotating or stationary stator vanes typically are placed downstream or upstream of rotor blades of the fans, compressors, and turbines. These vanes reduce the tangential flow component leaving the rotors, thereby increasing the static pressure of the fluid and setting the flow angle to a level appropriate for the downstream rotor. The stator vanes carry a lift on the airfoil of the stator vane due to a higher static pressure on the pressure side of the airfoil and a lower static pressure on the suction side of the airfoil.

Due to the large range of operating conditions experienced by an axial flow compressor over a typical operating cycle, flow rates and rotational speeds of the compressor also vary widely. This results in large shifts in the absolute flow angle entering the stator vanes. To allow the vanes to accommodate these shifts in flow angle without encountering high loss or flow separation, circumferential rows of variable stator vanes are constructed so that the vanes can be rotated about their radial (or approximately radial) axis.

Generally, variable stator vanes (VSVs) have spindles through their rotational axis that penetrate the casing, allowing the vanes to be rotated using an actuation mechanism. At the flowpath, there will typically be a button of material around the spindle which rotates along with the vane. However, the size of this button is normally limited by the pitchwise spacing of the VSVs, resulting in a portion of the vane chord at the endwalls where a gap exists between the flowpath and the vane.

Because there is a large pressure gradient between the pressure and suction sides of the vane, leakage flow is driven across this gap, resulting in reduced fluid turning and higher loss at the endwalls.

This leakage flow also causes flow non-uniformities (i.e. wakes) at the adjacent rotor blades, which may excite these blades causing potentially damaging vibrations in the rotor blades. It is, thus, desirable to reduce the chordwise extent of this gap and the accompanying leakage flow. To this end, VSV buttons have been designed to cover inner and outer diameter ends of the VSV airfoil. The coverage of the ends is desirable because it minimizes endwall losses due to leakage flow at the endwall gap between the vanes and the walls of the flow passageway.

Conventional VSV buttons typically have diameters equal to or slightly less than the pitchwise spacing between vanes at their respective locations. This is because larger buttons would overlap with one another making it physically impossible to fit the vane assemblies together. In some cases, designers have specified flats or arched cuts on the sides of the buttons to allow the use of larger button diameters, thereby achieving greater endwall coverage. However, these configurations typically result in large cavities between buttons and often have large flowpath gaps near the vane leading edges leading to undesirable losses and large wakes.

Thus, it is highly desirable to provide buttons which minimize endwall leakage and operate over a wide range of vane angle settings.

BRIEF DESCRIPTION OF THE INVENTION

A variable stator vane includes an airfoil mounted on a button centered about a rotational axis and leading and trailing edges and pressure and suction sides of the airfoil. The button has circular leading and trailing edges circumscribed about the rotational axis at a button radius and that generally correspond to the airfoil leading and trailing edges respectively. The circular leading edge is upstream of the circular trailing edge. contoured pressure and suction sides of the button extend from the circular leading edge to the circular trailing edge and are recessed inwardly from a perimeter circumscribed about the rotational axis at the button radius. The contoured pressure side has upstream and downstream pressure side portions and the suction side has upstream and downstream suction side portions. One of the upstream and downstream pressure side portions is substantially straight and another of the upstream and downstream pressure side portions is substantially convexly curved. One of the upstream and downstream suction side portions is substantially straight and another of the upstream and downstream suction side portions is substantially convexly curved. One of the upstream pressure side portion and the upstream suction side portion is substantially straight and another of the upstream pressure side portion and the upstream suction side portion is substantially convexly curved.

Another embodiment of the variable stator vane includes a circular second curved section of the downstream pressure side portion of the button and the circular second curved section extends from a downstream end point of the downstream pressure side portion to the trailing edge.

The downstream suction side portion of the button may generally coincide with the suction side of the airfoil.

A more particular embodiment of the variable stator vane includes the airfoil disposed between spaced apart outer and inner buttons centered about a rotational axis. An outer spindle may extend outwardly from the outer button and an inner spindle may extend inwardly from the inner button.

The variable stator vane design may be incorporated in a gas turbine engine variable vane assembly having at least one circular row of variable stator vanes wherein each of the variable stator vanes includes an airfoil disposed between spaced apart outer and inner buttons centered about a rotational axis.

DETAILED DESCRIPTION OF THE INVENTION

Figure 1:
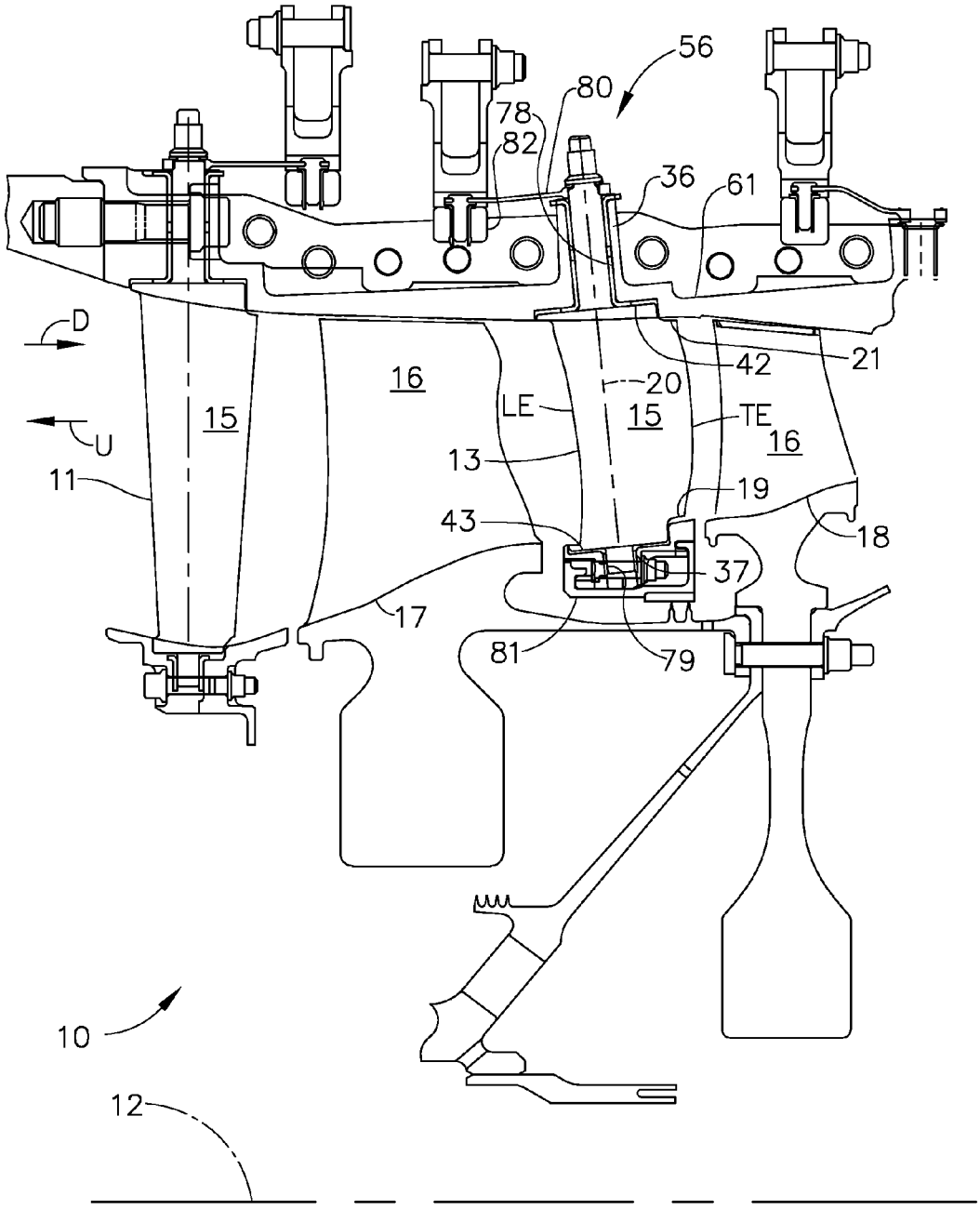
FIG. 1 is a sectional view illustration of a portion of a gas turbine engine high pressure compressor variable stator vanes and contoured buttons.

Illustrated in FIG. 1 is a portion of an exemplary turbofan gas turbine engine high pressure compressor 10 axisymmetrical about a longitudinal or axial centerline axis 12. Circular first and second rows 11, 13 of variable stator vanes 15 (VSVs) are disposed in the compressor 10 and used to optimize the direction at which gases flowing through the compressor 10 enter first and second rows 17, 18 of rotatable blades 16. Though the exemplary embodiment of the VSVs disclosed herein is for a high pressure compressor, the VSV's may be used in other compressor sections and in fan and turbine sections of a gas turbine engine as well. A compressor casing 61 supports variable stator vane assemblies 56 which include the variable stator vanes 15.

Figure 2:
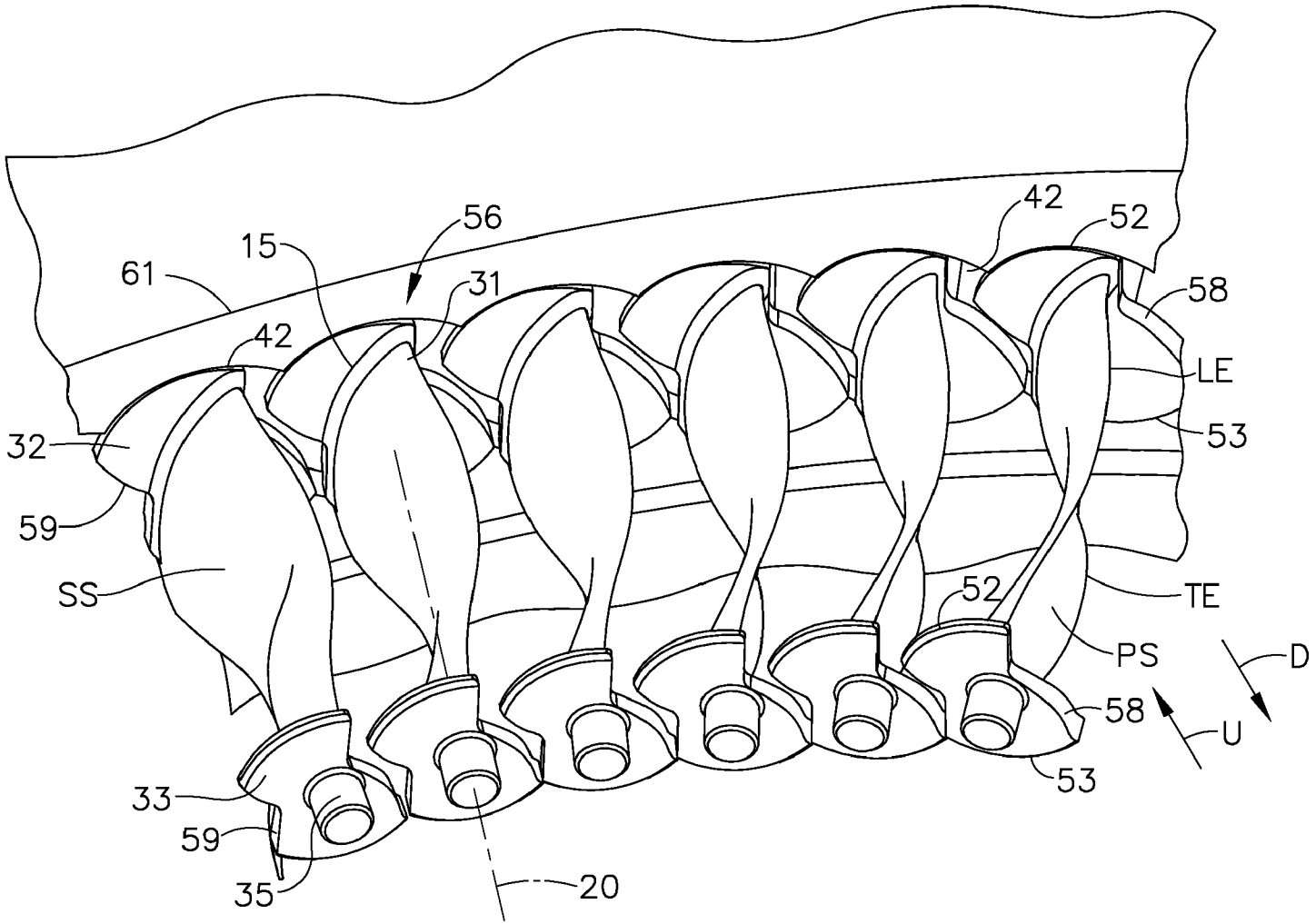
FIG. 2 is a perspective view illustration of several of the compressor variable stator vanes and contoured buttons illustrated in FIG. 1.
Figure 3:
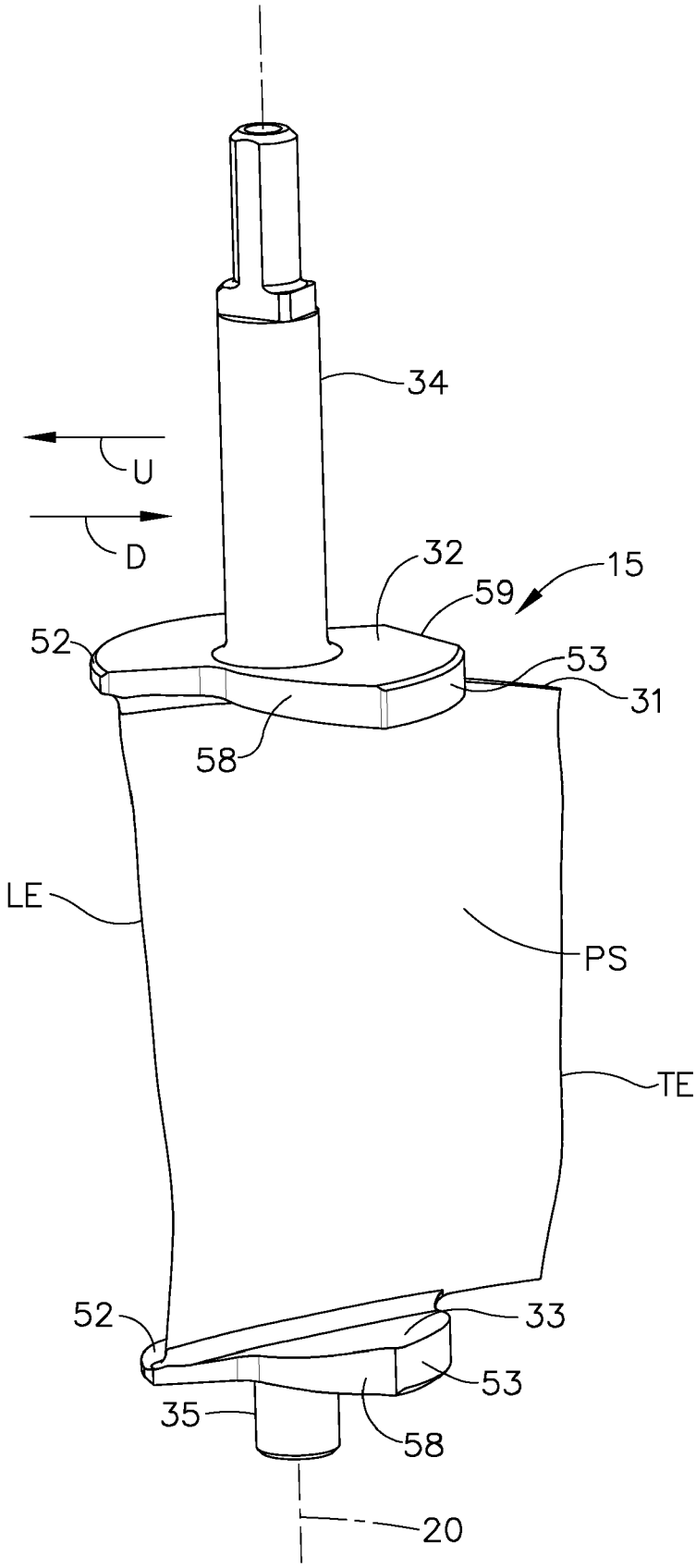
FIG. 3 is an enlarged perspective view illustration of one of the compressor variable stator vanes and its contoured buttons illustrated in FIG. 2.
Figure 4:
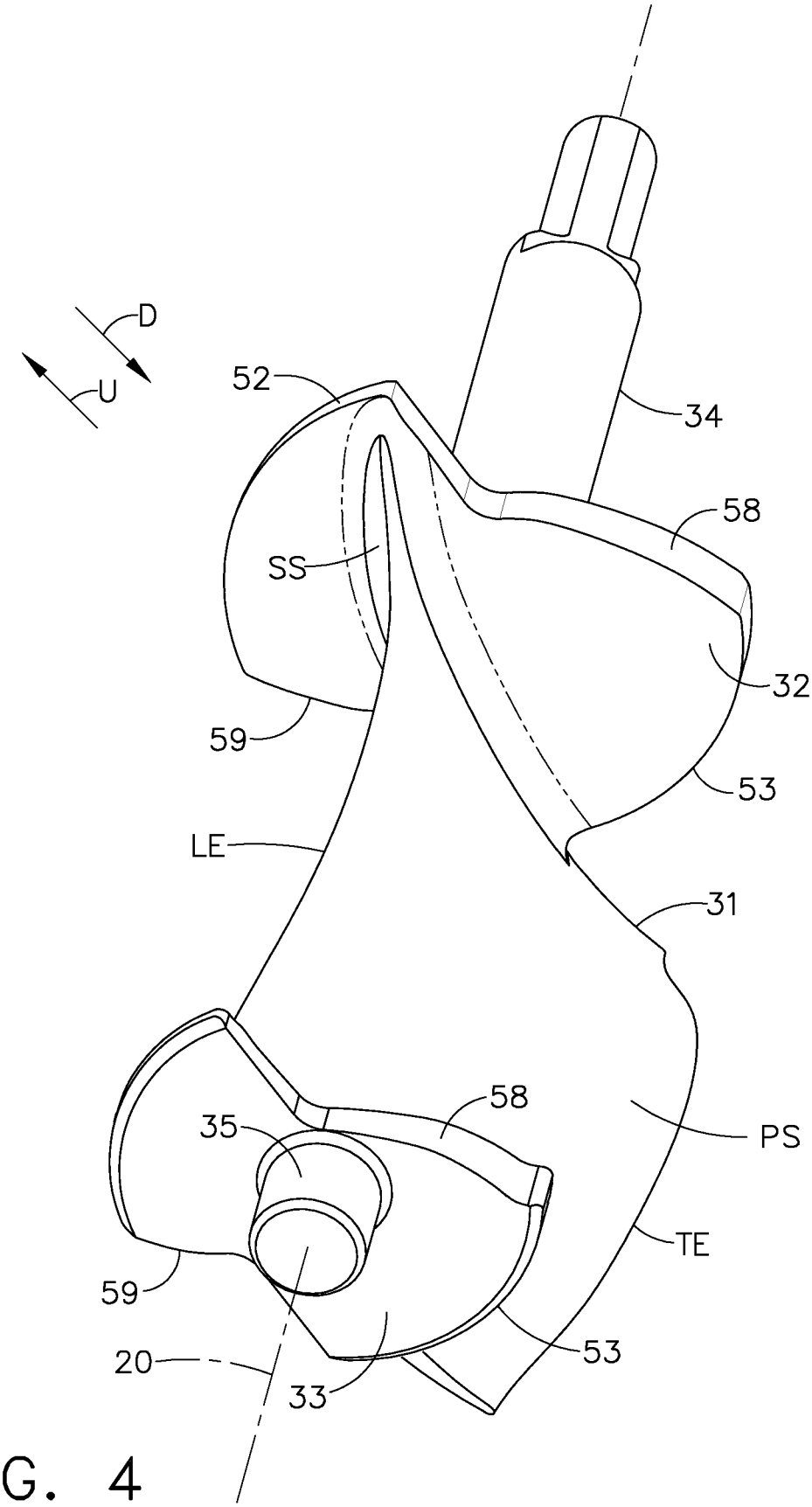
FIG. 4 is another enlarged perspective view illustration looking radially outwardly of one of the compressor variable stator vanes illustrated in FIG. 3.
Figure 5:
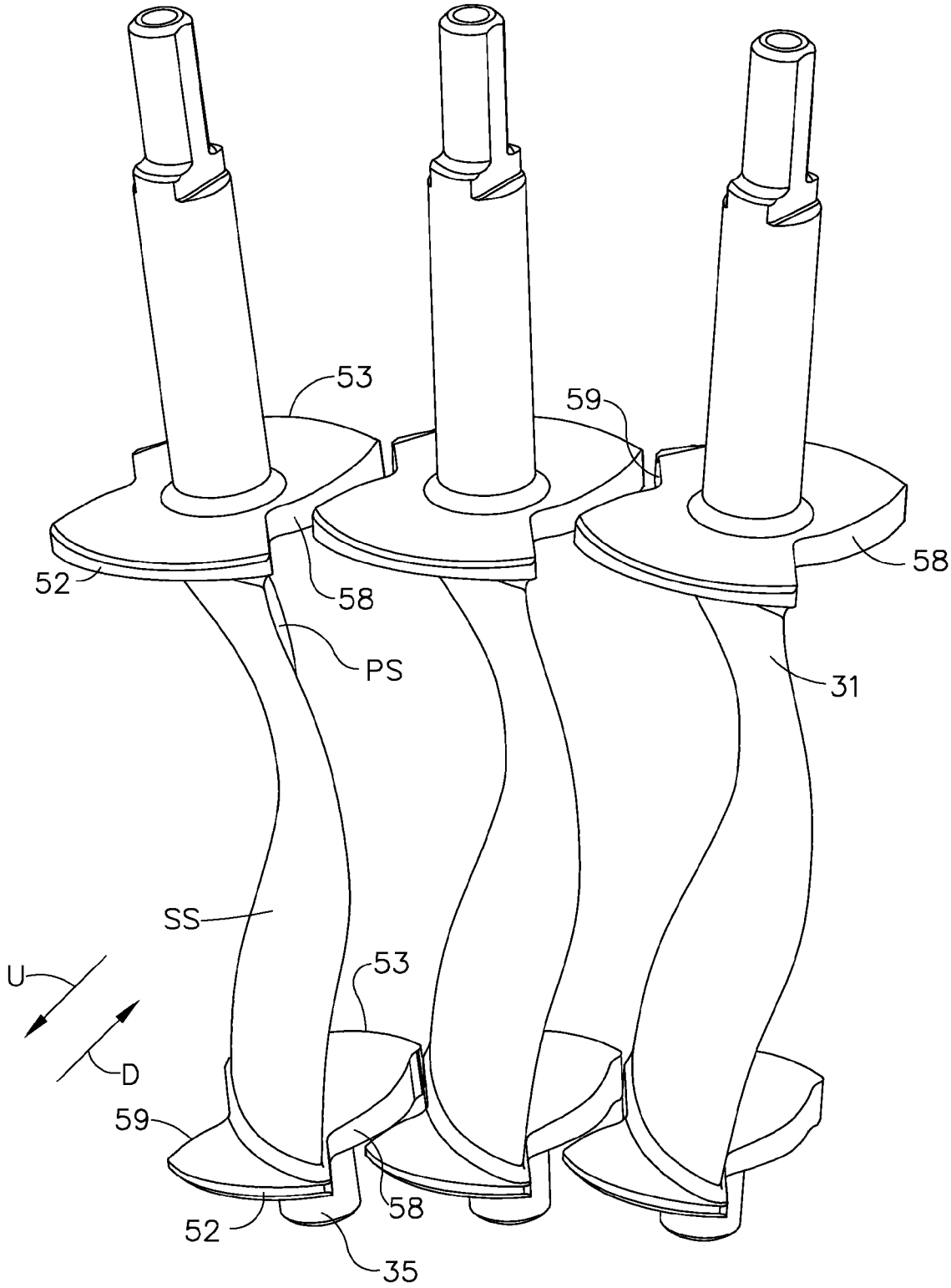
FIG. 5 is a perspective view illustration looking radially inwardly of three adjacent compressor variable stator vanes illustrated in FIG. 3.

Referring to FIGS. 2-4, each variable stator vane assembly 56 includes a plurality of variable stator vanes 15. Each variable stator vane 15 is pivotable or rotatable about a rotational axis 20. Each variable stator vane 15 has an airfoil 31 disposed between spaced apart outer and inner buttons 32, 33. An outer spindle 34 extends outwardly from the outer button 32 and an inner spindle 35 extends inwardly from the inner button 33. The outer and inner spindles 34, 35 are rotatably supported in outer and inner trunnions 36, 37 respectively as illustrated in FIG. 1.

Referring to FIG. 1, the outer spindle 34 is rotatably disposed through the outer trunnion 36 which, in turn, is mounted in an outer opening 78 in the casing 61. The inner spindle 35 is rotatably disposed through the inner trunnion 37 which, in turn, is mounted in an inner opening 79 in an inner ring 81 which is spaced radially inwardly of the casing 61. A lever arm 80 extends from the outer spindle 34 and is linked to an actuation ring 82 for rotating or pivoting and setting the flow angle of the variable stator vanes 15.

Referring to FIGS. 1 and 2, the outer and inner buttons 32, 33 are rotatably disposed in outer and inner circular recesses 42, 43 in the casing 61 and the inner ring 81 respectively. Each airfoil 31 has an airfoil leading edge LE upstream U of an airfoil trailing edges TE and pressure and suction sides PS, SS. Referring to FIGS. 2-6, the outer and inner buttons 32, 33 each have circular leading and trailing edges 52, 53 generally corresponding to the airfoil leading and trailing edges LE, TE and the circular leading edge 52 is upstream of the circular trailing edge 53. The circular leading and trailing edges 52, 53 are circumscribed about the rotational axis 20 at a button radius R. The outer and inner buttons 32, 33 each have contoured pressure and suction sides 58, 59 extending downstream D from the circular leading edge 52 to the circular trailing edge 53. The contoured pressure and suction sides 58, 59 generally correspond to and face in the same circumferential directions as the airfoil pressure and suction sides PS, SS respectively.

Figure 6:
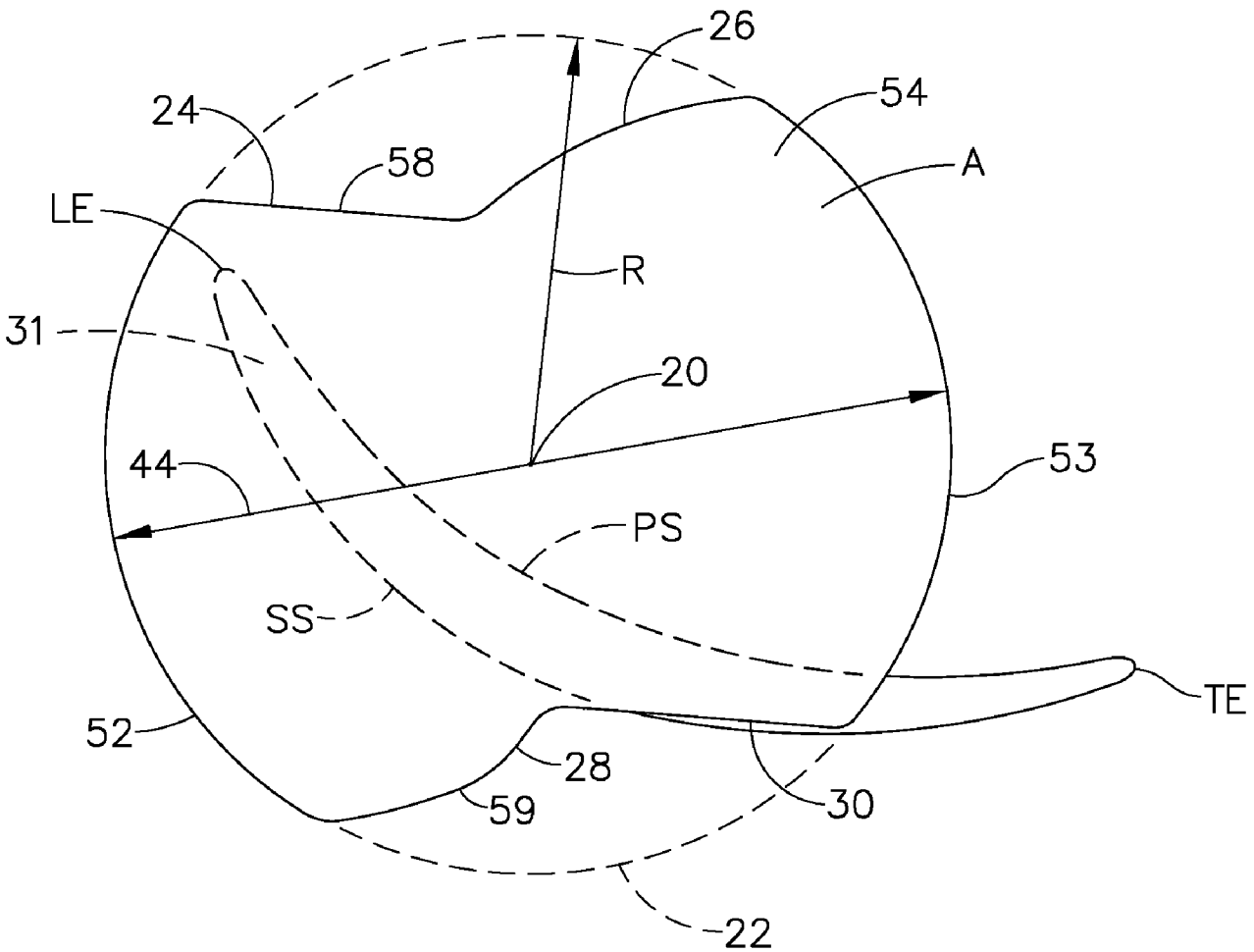
FIG. 6 is a diagrammatic illustration of an airfoil cross-section superimposed on a contoured button of one of the vanes illustrated in FIG. 3.

Illustrated in FIG. 6, is an exemplary button 54 representative of the outer and inner buttons 32, 33. The button 54 includes the circular leading and trailing edges 52, 53 which define a circular perimeter 22 within which the button 54 rotates about the rotational axis 20. The circular perimeter 22 is circumscribed about the rotational axis 20 at the button radius R from the rotational axis 20. The contoured pressure and suction sides 58, 59 are cut out or recessed in from the perimeter 22. The contoured pressure side 58 has upstream and downstream pressure side portions 24, 26. The contoured suction side 59 has upstream and downstream suction side portions 28, 30. The side portions are either substantially straight (linear) or substantially convexly curved (curvilinear). Side portions, in diagonally opposite quadrants of the button, are similarly shaped and are either substantially straight or convexly curved. Upstream pressure and suction side portions have opposite shapes, one being substantially straight and the other being substantially convexly curved. Note that the convexly curved side portions, in diagonally opposite quadrants of the button, are similarly shaped but most likely do not have the same curved shape.

Another way of describing this is as follows: one of the upstream and downstream pressure side portions 24, 26 is substantially straight and another of the upstream and downstream pressure side portions 24, 26 is substantially convexly curved; one of the upstream and downstream suction side portions 28, 30 is substantially straight and another of the upstream and downstream suction side portions 28, 30 is substantially convexly curved; and one of the upstream pressure side portion 24 and the upstream suction side portion 28 is substantially straight and another of the upstream pressure side portion 24 and the upstream suction side portion 28 is substantially convexly curved.

The button 54 illustrated herein has a linear upstream pressure side portion 24 and a linear downstream suction side portion 30. Thus, the button 54 illustrated herein also has a convexly curved upstream suction side portion 28 and a convexly curved downstream pressure side portion 26. Alternatively, the upstream pressure side portion 24 and the downstream suction side portion 30 may be convexly curved and the upstream suction side portion 28 and the downstream pressure side portion 26 may be straight. The combinations are designed to maximize the area A of the button 54 while accommodating a large turning angle (not shown) of the variable stator vanes 15. In order to further maximize the area A of the button 54, the downstream suction side portion 30 of the button 54 generally coincides with the suction side SS of the airfoil 31 in the exemplary embodiment of the button 54 illustrated in FIG. 6.

Figure 7:
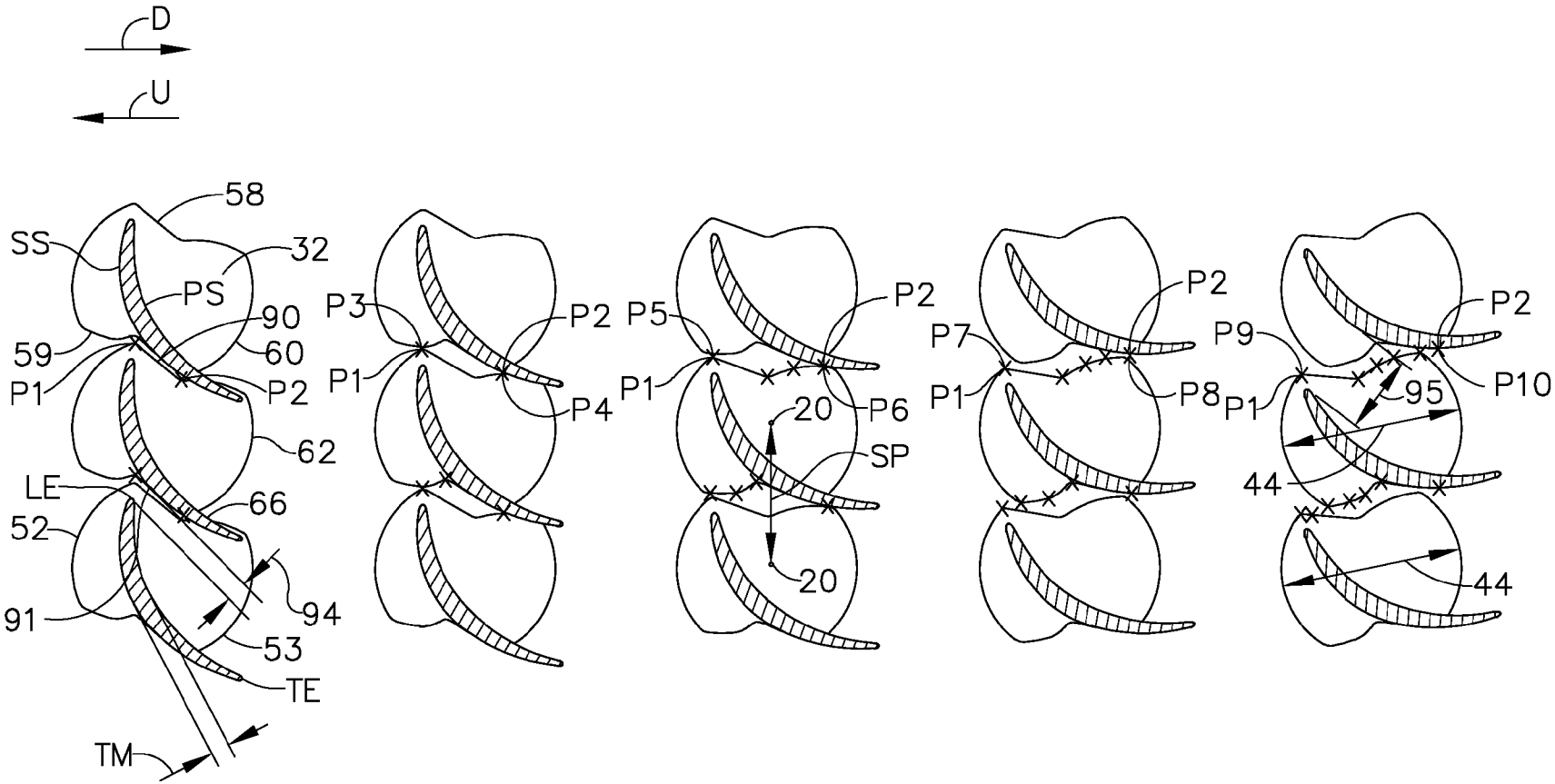
FIG. 7 is a diagrammatic illustration of an exemplary method used to contour the buttons illustrated in FIG. 3.

The contoured pressure and suction sides 58, 59 are cut out or recessed in from the perimeter 22 and shaped to accommodate button diameters 44 of the buttons that are greater than pitchwise spacing SP between adjacent ones of the airfoils 31 as measured from rotational axes 20 of the airfoils 31 of adjacent ones of the variable stator vanes 15 as illustrated in FIGS. 6 and 7. Buttons having button diameters greater than pitchwise spacing would otherwise overlap with one another, making it physically impossible to fit the vane assemblies together. This button geometry allows increased VSV endwall coverage while simultaneously limiting the size of the exposed cavities in the outer and inner circular recesses 42, 43 as illustrated in FIG. 1 as well as in inner and outer endwall regions 19 and 21 at critical operating conditions.

FIG. 7 illustrates a method for sizing and shaping the buttons 54 illustrated in FIG. 6 using adjacent first and second button templates 60, 62 each of which includes an airfoil template 66 mounted thereon. The button diameter 44 of the first and second button template 60, 62 is set to a maximum reasonable size giving a combination of high VSV endwall coverage and acceptable overlap. The exemplary embodiment of the method illustrated herein uses 80-100% coverage of the airfoil endwall, which is represented by the airfoil template 66, or 10-40% button overlap which is overlap of adjacent button perimeters 22. An exemplary method of drawing profiles for contoured pressure and suction sides 58, 59 illustrated herein includes the following steps.

Step 1, the first and second button templates 60, 62 are rotated so the airfoil templates 66 are positioned at their maximum closed position as illustrated by the narrowest allowable opening 94 between the leading edge LE and the suction side SS of adjacent airfoil endwalls or airfoil template 66. A first point P1 is located on the perimeter 22 of the second button template 62 substantially nearest the leading edge LE of the airfoil template 66 of the second button template 62. Point P1 is generally located within 50%-200% of an airfoil max thickness TM of the leading edge LE.

A second point P2 is located substantially near an intersection of the perimeter 22 of the first button template 60 and the suction side SS of the airfoil template 66 on the adjacent first button template 60. Point P2 is generally located within 50% of airfoil max thickness TM of the airfoil suction side SS. A first straight line 90 between the first and second points P1, P2 defines the upstream pressure side portion 24 of the contoured pressure side 58 and the downstream suction side portion 30 of the contoured suction side 59 of the button 54. The first point P1 also defines the intersection of the circular leading edge 52 and the upstream pressure side portion 24 of the contoured pressure side 58 of the button 54.

Figure 8:
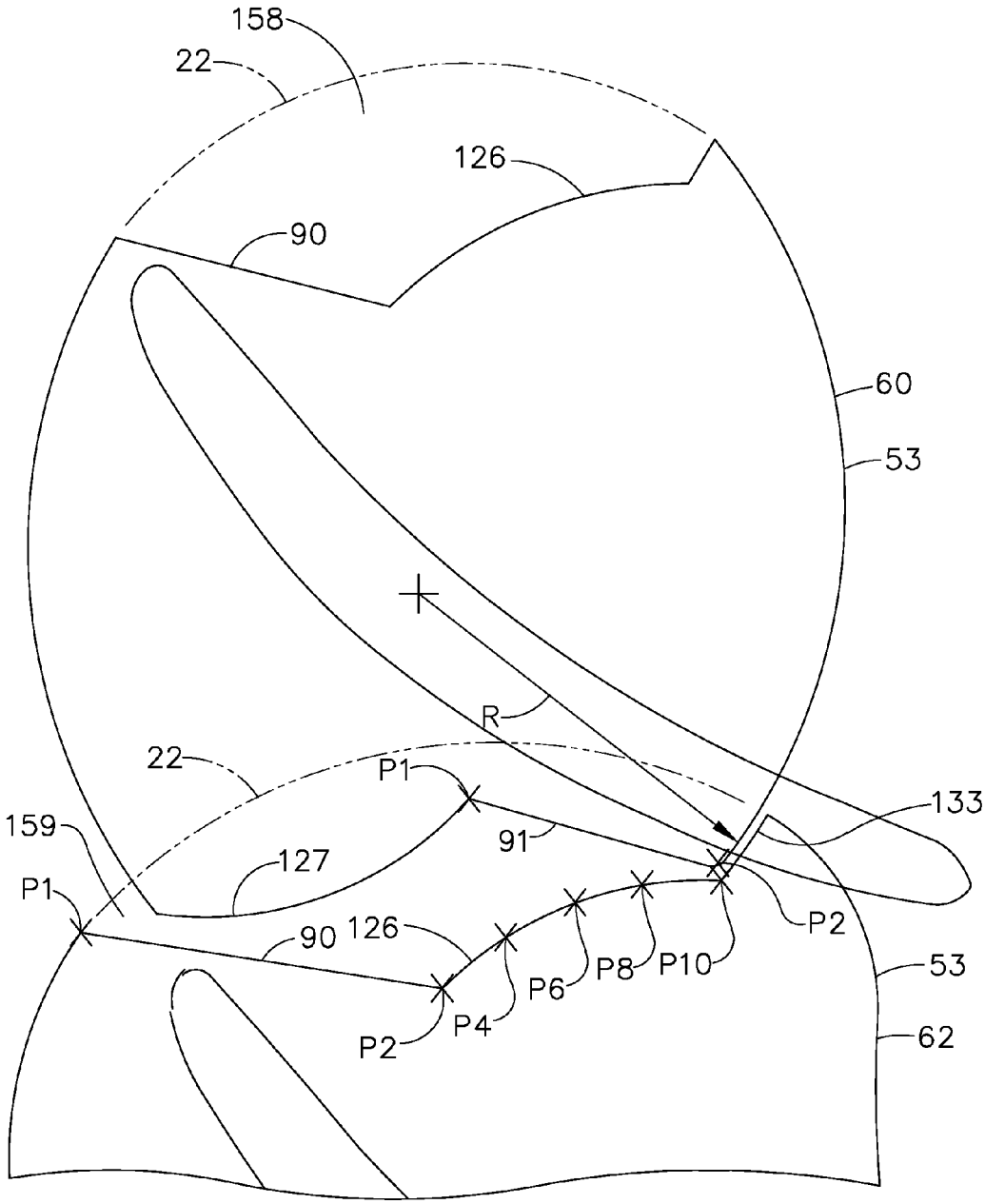
FIG. 8 is a diagrammatic illustration of results from the exemplary method illustrated in FIG. 7.

The airfoil templates 66 are then rotated incrementally open until the airfoil templates 66 are positioned at their maximum open position as illustrated by the widest allowable opening 95 between the leading edge LE and the suction side SS of adjacent airfoil endwalls or airfoil template 66. By rotating the respective button templates 62 third and fourth points P3 and P4 are defined on the buttons to clear the corners (the first and second points P1, P2) of the adjacent buttons. This process is repeated to define or locate fifth through tenth points P5-P10 until the corners clear the adjacent button. Then, the points are connected to create first and second smooth curve 126, 127 and combined with the first and a second straight lines 90, 91 respectively, as illustrated in FIG. 8, to define the contoured pressure and suction sides 58, 59 of the buttons 54.

If the vanes are rotated to their full open position, and the second point P2 on the first button template 60 has not cleared the trailing edge 53 of the second button template 62, then a second curved section 133 of the downstream pressure side portion 26 of the button 54 is needed. The second curved section 133 is defined by a circular curve between the tenth point P10, or last point, of the first smooth curve 126 and the trailing edge 53 of the second button template 62 and is concentric with the trailing edge 53 of the first button template 60. The above process describes how to generate first and second nominal button cutouts 158, 159 for the first and second button templates 60, 62 used to define the contoured pressure and suction sides 58, 59 of the buttons 54. The nominal cutouts will be offset closer to each other by a small amount, typically 0-0.02", to allow actual parts to be assembled with normal manufacturers variation, internal corners between adjacent surfaces of the upstream and downstream suction side portions 28, 30; upstream and downstream pressure side portions 24, 26; and the second curved section 133 will be blended, typically, with a fillet radius in a range of about 0.03-0.10 inches, for manufacturability and mechanical robustness.

The preferred embodiment provides a minimum overall gap between the buttons, although not necessarily the minimum pocket at the nominal design angle, and provides another potential benefit in that, in the event of a broken lever arm 80 (which sets the angle of the VSV), the affected vane will actually be guided to follow the adjacent vanes (without broken arms), rather than simply be subject to aero loads or lock in place due to friction, which can cause excessive aero distortion and induce damaging vibration to the rotor blades.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed:

1. A variable stator vane comprising:

an airfoil mounted on a button centered about a rotational axis, the airfoil including airfoil leading and airfoil trailing edges and airfoil pressure and airfoil suction sides, the button having circular leading and circular trailing edges circumscribed about the rotational axis at a button radius and generally corresponding to the airfoil leading and airfoil trailing edges respectively, the circular leading edge being upstream of the circular trailing edge, contoured pressure and contoured suction sides extending from the circular leading edge to the circular trailing edge, the contoured pressure and contoured suction sides being recessed inwardly from a perimeter circumscribed about the rotational axis at the button radius, the contoured pressure side having upstream and downstream pressure side portions, the contoured suction side having upstream and downstream suction side portions, one of the upstream and downstream pressure side portions being substantially straight and another of the upstream and downstream pressure side portions being substantially convexly curved, one of the upstream and downstream suction side portions being substantially straight and another of the upstream and downstream suction side portions being substantially convexly curved, and one of the upstream pressure side portion and the upstream suction side portion being substantially straight and another of the upstream pressure side portion and the upstream suction side portion being substantially convexly curved.

2. A variable stator vane as claimed in claim 1, further comprising a circular second curved section of the downstream pressure side portion of the button and the circular second convexly curved section extending between a downstream end point of the downstream pressure side portion and the circular trailing edge.

3. A variable stator vane as claimed in claim 1, further comprising the downstream suction side portion of the button generally coinciding with the airfoil suction side of the airfoil.

4. A variable stator vane comprising:

an airfoil disposed between spaced apart outer and inner buttons centered about a rotational axis, the airfoil including airfoil leading and airfoil trailing edges and airfoil pressure and airfoil suction sides, each of the outer and inner buttons having circular leading and circular trailing edges circumscribed about the rotational axis at a button radius and generally corresponding to the airfoil leading and airfoil trailing edges respectively, the circular leading edge being upstream of the circular trailing edge, contoured pressure and contoured suction sides extending from the circular leading edge to the circular trailing edge, the contoured pressure and contoured suction sides being recessed inwardly from a perimeter circumscribed about the rotational axis at the button radius, the contoured pressure side having upstream and downstream pressure side portions, the contoured suction side having upstream and downstream suction side portions, one of the upstream and downstream pressure side portions being substantially straight and another of the upstream and downstream pressure side portions being substantially convexly curved, one of the upstream and downstream suction side portions being substantially straight and another of the upstream and downstream suction side portions being substantially convexly curved, and one of the upstream pressure side portion and the upstream suction side portion being substantially straight and another of the upstream pressure side portion and the upstream suction side portion being substantially convexly curved.

5. A variable stator vane as claimed in claim 4, further comprising an outer spindle extending outwardly from the outer button and an inner spindle extending inwardly from the inner button.

6. A variable stator vane as claimed in claim 5, further comprising a circular second curved section of the downstream pressure side portion of either or both of the outer and inner buttons and the circular second convexly curved section extending between a downstream end point of the downstream pressure side portion and the circular trailing edge.

7. A variable stator vane as claimed in claim 6, further comprising the downstream suction side portion of the outer and inner buttons generally coinciding with the airfoil suction side of the airfoil.

8. A gas turbine engine variable vane assembly comprising:

at least one circular row of variable stator vanes, each of the variable stator vanes including an airfoil disposed between spaced apart outer and inner buttons centered about a rotational axis, the airfoil including airfoil leading and airfoil trailing edges and airfoil pressure and airfoil suction sides, each of the outer and inner buttons having circular leading and circular trailing edges circumscribed about the rotational axis at a button radius and generally corresponding to the airfoil leading and airfoil trailing edges respectively, the circular leading edge being upstream of the circular trailing edge, contoured pressure and contoured suction sides extending from the circular leading edge to the circular trailing edge, the contoured pressure and contoured suction sides being recessed inwardly from a perimeter circumscribed about the rotational axis at the button radius, the contoured pressure side having upstream and downstream pressure side portions, the contoured suction side having upstream and downstream suction side portions, one of the upstream and downstream pressure side portions being substantially straight and another of the upstream and downstream pressure side portions being substantially convexly curved, one of the upstream and downstream suction side portions being substantially straight and another of the upstream and downstream suction side portions being substantially convexly curved, and one of the upstream pressure side portion and the upstream suction side portion being substantially straight and another of the upstream pressure side portion and the upstream suction side portion being substantially convexly curved.

9. A gas turbine engine variable vane assembly as claimed in claim 8, further comprising an outer spindle extending outwardly from the outer button and an inner spindle extending inwardly from the inner button.

10. A gas turbine engine variable vane assembly as claimed in claim 9, further comprising a circular second curved section of the downstream pressure side portion of either or both of the outer and inner buttons and the circular second curved section extending between a downstream end point of the downstream pressure side portion and the circular trailing edge.

11. A gas turbine engine variable vane assembly as claimed in claim 10, further comprising the downstream suction side portion of the each of the outer and inner buttons generally coinciding with the airfoil suction side of the airfoil.

* * * * *